United States Patent [19]

Wern et al.

[11] Patent Number: 4,569,159

[45] Date of Patent: Feb. 11, 1986

[54] ABRASIVES DISTRIBUTOR

[75] Inventors: Michael J. Wern, Orland Park, Ill.; Henry E. Wern, Homosassa Springs, Fla.

[73] Assignee: Engineered Abrasives, Inc., Worth, Ill.

[21] Appl. No.: 761,299

[22] Filed: Jul. 29, 1985

Related U.S. Application Data

[63] Continuation of Ser. No. 487,511, Apr. 22, 1983, abandoned.

[51] Int. Cl.[4] ..... B24C 3/04

[52] U.S. Cl. ..... 51/410; 51/437; 51/428; 222/630

[58] Field of Search ..... 51/410, 436, 437, 427, 51/431, 426, 263, 319, 421, 428; 222/167, 637, 169, 630

[56] References Cited

U.S. PATENT DOCUMENTS

| | | | |
|---|---|---|---|
| 1,424,713 | 8/1922 | Coburn | 51/431 |
| 1,755,575 | 4/1930 | Eckler | 51/421 |
| 2,274,172 | 2/1942 | Swisher | 51/426 |
| 3,423,976 | 1/1969 | Burney et al. | 51/319 |
| 3,675,373 | 7/1972 | Putnam | 51/426 |

FOREIGN PATENT DOCUMENTS

| | | | |
|---|---|---|---|
| 0195748 | 2/1908 | Fed. Rep. of Germany | 51/428 |
| 0227806 | 4/1910 | Fed. Rep. of Germany | 51/421 |

*Primary Examiner*—Frederick R. Schmidt
*Assistant Examiner*—Robert A. Rose
*Attorney, Agent, or Firm*—Trexler, Bushnell & Wolters, Ltd.

[57] ABSTRACT

A novel abrasives distributor is disclosed. The distributor comprises a movable assembly, and at least one gun. The assembly preferably includes an elongated, hollow shaft having an inlet, and a hollow manifold which is in communication with the hollow shaft and which is carried at one end thereof. The assembly further preferably includes a receptacle which surrounds the shaft and which is preferably carried by the manifold. The manifold includes at least one manifold outlet. A transport fluid, such as air, is introduceable into the shaft inlet, is passable through the shaft and manifold, and is exitable from the manifold via the manifold outlet. The gun is preferably independently carried by an arm which, in turn, is carried by the depends from the assembly. The assembly is movable relative to a workpiece. The receptacle includes at least one receptacle outlet. Abrasives, from an abrasive source, are introduceable into the receptacle and are exitable from the receptacle via the receptacle outlet. The gun preferably includes a through bore, a transverse port which communicates with the gun bore, a first conduit which provides communication between the manifold outlet and the gun bore, and a second conduit which provides communication between the receptacle outlet and the gun port. The gun is preferably variably positionable relative to the arm such that abrasives introduced into the gun are preferably variably directable relative to the workpiece.

6 Claims, 2 Drawing Figures

ABRASIVES DISTRIBUTOR

This application is a continuation of application Ser. No. 487,511 filed Apr. 22, 1983, now abandoned.

BACKGROUND OF THE INVENTION

The present invention is directed to an abrasives distributor. More particulary, the present invention is directed to a variably-directable, rotary, impingement-type abrasives distributor.

Abrasives distributors, such as, for example, sand blasters, are well known in the art. Such prior art abrasives distributors generally have at least one gun or nozzle through which an abrasive substance is directed toward a target or workpiece. In such prior art distributors, such guns usually are either fixed relative to the target or are caused to move in a reciprocal or reciprocating manner (such as, for example, back and forth) relative to the target or workpiece.

Moreover, in such prior art abrasives distributors, an abrasives receptacle or cup (used for supplying abrasives to such a gun or nozzle) is generally not fixed relative to such gun or nozzle.

Also, in such prior art distributors, the abrasive substance is generally forced or pushed (such as, for example, by blowing pressurized air and the abrasives) through the gun, which often results in premature failure of the gun.

OBJECTS AND SUMMARY OF THE INVENTION

Accordingly, it is a general object of this invention to provide a novel abrasives distributor.

A more specific object is to provide such an abrasives distributor having at least one gun and a receptacle for supplying such a gun with abrasives, where both the gun and nozzle move in unison relative to a target or workpiece.

A still more specific object is to provide such an abrasives distributor which is variably-directable, and which also possesses rotary action.

A further object is to provide such an abrasives distributor which does not force or push the abrasive substance through the gun, but rather, which pulls or draws the abrasive substance through the gun (such as, for example, through suction or gravitational forces).

Briefly, and in accordance with the foregoing objects, a novel abrasives distributor will now be summarized. The distributor comprises a movable assembly and at least one gun. The assembly preferably includes an elongated, hollow shaft having an inlet, and a hollow manifold which is in communication with the hollow shaft and which is carried at one end of the shaft. The assembly further preferably includes a receptacle or cup which surrounds the shaft and which is preferably carried by the manifold. The manifold includes at least one manifold outlet. A transport fluid, such as air, is introduceable into the shaft inlet, is passable through the shaft and manifold, and is exitable from the manifold via the manifold outlet. The gun is preferably independently carried by an arm which, in turn, is carried by and depends from the assembly. The assembly is movable relative to a target or workpiece. The cup includes at least one cup outlet. Abrasives, from an abrasives source, are introduceable into the cup and are exitable from the cup via the cup outlet. The gun preferably includes a through bore, a transverse port which communicates with the gun bore, a first conduit which provides communication between the manifold outlet and the gun bore, and a second conduit which provides communication between the cup outlet and the gun port. The gun is preferably variably positionable relative to the arm such that abrasives introduced into the gun are preferably variably directable relative to the target or workpiece.

BRIEF DESCRIPTION OF THE DRAWINGS

The foregoing, as well as other objects, features or advantages of the present invention will become more readily understood upon reading the following detailed description of the illustrated embodiment, together with reference to the drawings, wherein.

DETAILED DESCRIPTION OF THE ILLUSTRATED EMBODIMENT

The novel abrasives distributor 10 preferably includes a base, a movable assembly 14 (FIGS. 1, 2), and a plurality of nozzles or guns 16. The base preferably includes legs for supporting the base on the ground or floor of a workplace. More preferably, five such guns 16 are carried by the distributor 10. It can be appreciated, by those skilled in the art, that the distributor 10 of the present invention can, if desired, include only one such gun 16.

Figure 2:
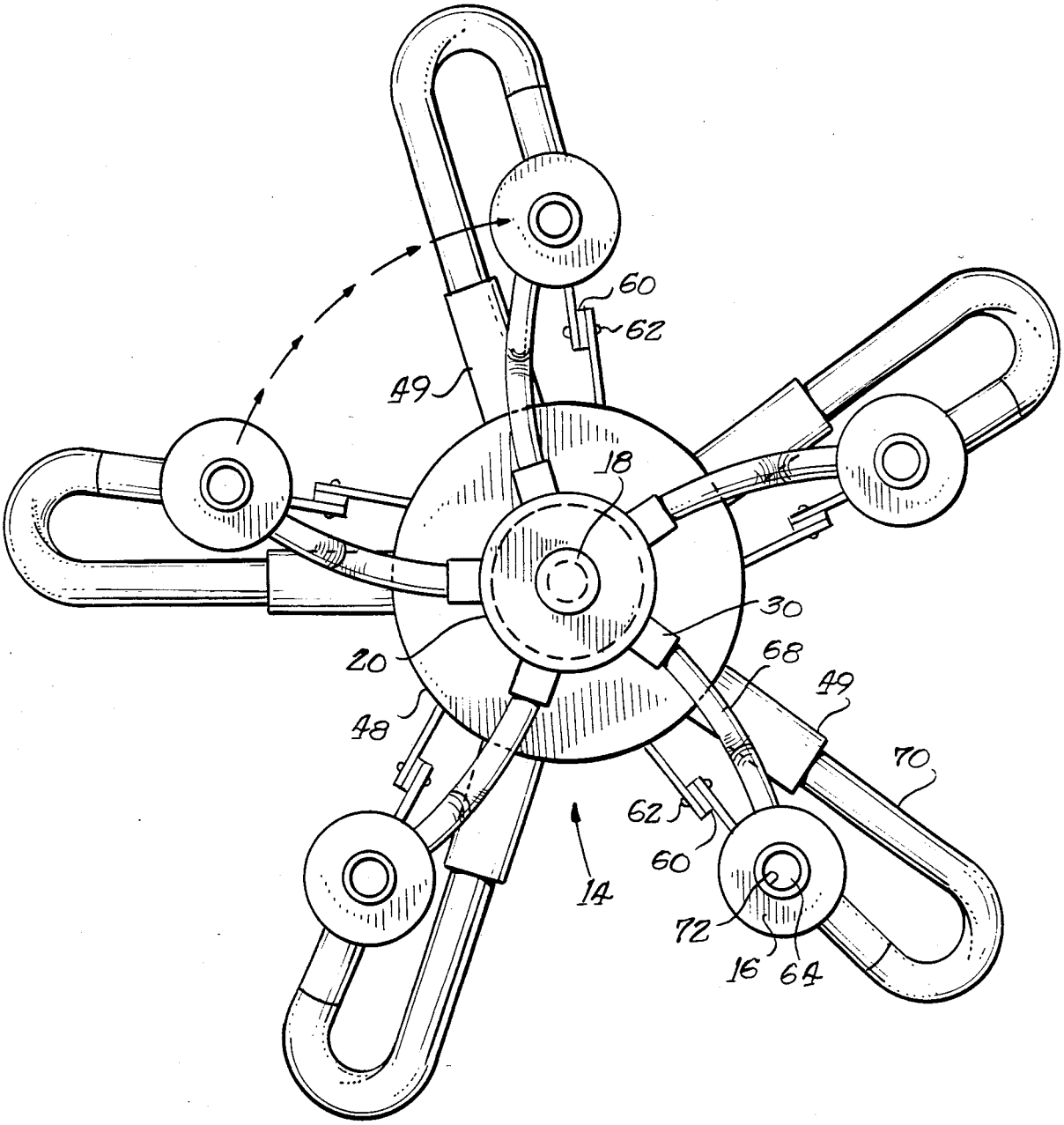
FIG. 2 is a bottom view (on an enlarged scale) of a portion of the abrasives distributor of the present invention, the view taken generally from the plane 2-2 in FIG. 1.

The assembly 14 is preferably rotatable relative to a target or workpiece in a manner which will be described in greater detail below. The assembly 14 preferably includes an elongated hollow shaft or member 18 and a manifold 20, both of which are preferably circular in cross section (FIG. 2). The shaft 18 preferably comprises three portions and includes flanges 22 for joining the shaft portions. An inlet portion of the shaft 18 is preferably coupled through a connector 24 to a commercially-available, rotary, air coupling 26. Transport fluid, preferably pressurized air from an air source, is introduceable into the coupling 26 via a conduit 28. The connector 24 is preferably a durable, non-springy, plastic, rubber or rubber-like material for substantially isolating vibration of the coupling 26 from vibration of the shaft 18.

The manifold 20 is hollow, is in communication with the shaft 18, and is preferably affixed to the outlet portion of the shaft 18. The manifold 20 further includes a plurality of (preferably five) manifold outlets 30. The outlets 30 are preferably equally spaced about the circumference of the manifold 20 and are preferably radially outwardly disposed therefrom (FIG. 2).

Figure 1:
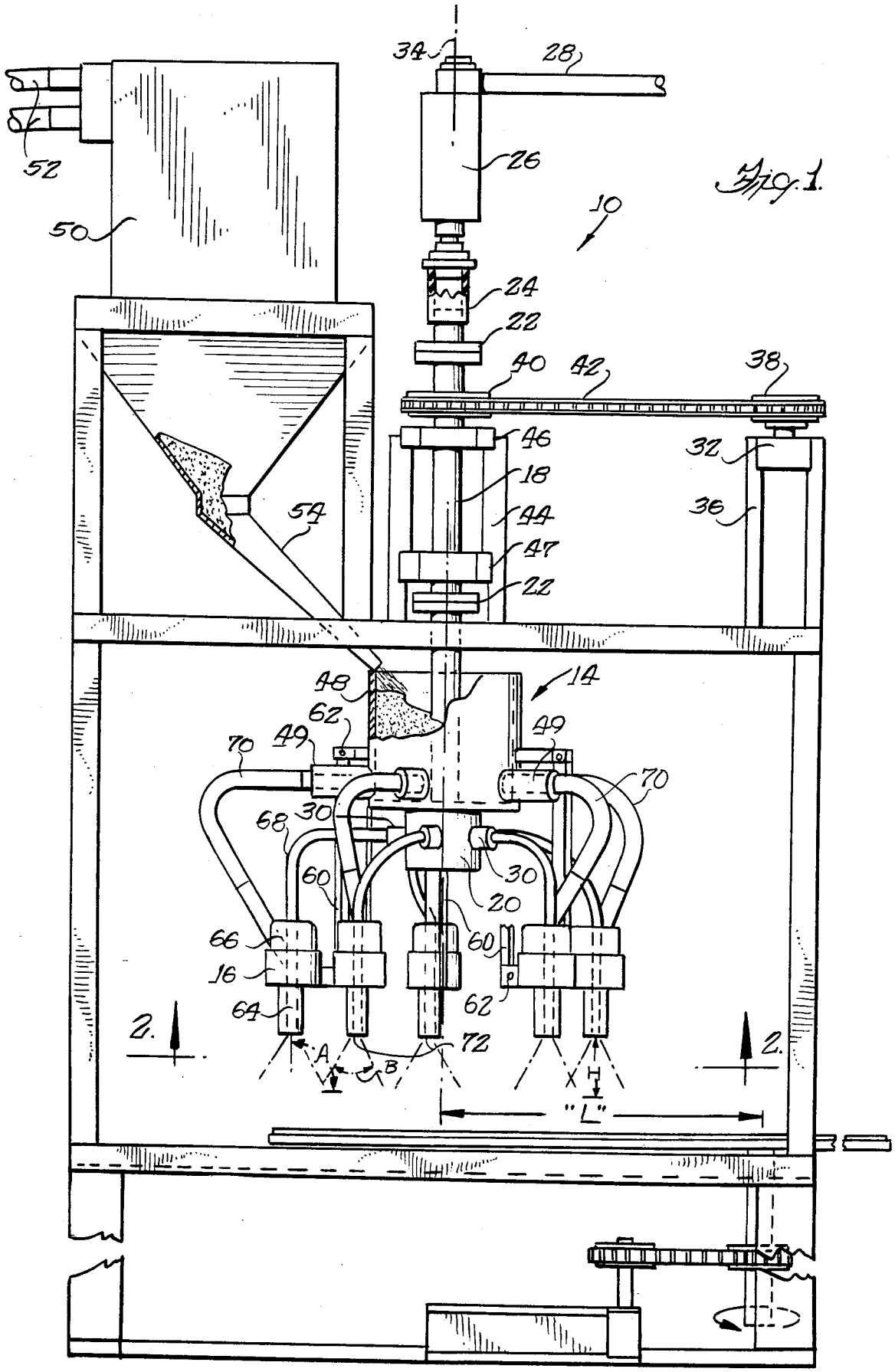
FIG. 1 is a side view, partially in section, of the abrasives distributor of the present invention.

The assembly 14 also preferaby includes a variable-speed drive means (more preferably a D-C motor) 32 for rotating the shaft 18 about an axis 34 which is preferably fixed relative to the base (FIG. 1). The drive means 32 is supported upon a first stand 36, which, in turn, is carried by the base. A first sprocket 38 affixed to the drive means 32, a second sprocket 40 affixed to the shaft 18, and a drive chain 42 are coupled in a known manner so as to permit the drive means 32 to cause the shaft 18 to rotate about the axis 34. A second stand 44, also carried by the base, preferably has upper and lower bearings 46, 47 respectively appropriately affixed thereto. The bearings 46, 47 are spaced, one from the other; and each one of the bearings 46, 47 circumferentially surrounds and engages the shaft 18 for permitting the shaft 18 to rotate about the axis 34 relative to the base.

The assembly 14 further preferably includes an abrasives collector, receptacle or cup 48 which surrounds the shaft 18 and which is preferably carried by the manifold 20. The cup or receptacle 48 includes a plurality of (preferably five) cup outlets 49. The cup 48 is preferably circular in cross section (FIG. 2). The outlets 49 are preferably equally spaced about the circumference of a lower portion of the cup 48 (FIG. 1) and are preferably radially outwardly disposed therefrom (FIG. 2).

Abrasives, from an abrasive source, are introduceable into a hopper 50 via conduits 52. The hopper 50 preferably includes an outlet spout 54 which feeds abrasives into the cup 48. Abrasives introduced into the cup 48 preferably exit through the cup 48 via the cup outlets 49 in a manner which will be described in greater detail below. Such abrasives can be, but are not necessarily limited to, stone, sand, aluminum oxide or garnet particles; glass or plastic beads; steel shot or grit; and walnut or peanut shells or portions.

The base further preferably includes a turntable or platform, rotatable by means such as a motor about an axis of a shaft spaced a distance "L" from the shaft 34. It can be appreciated that the base can further include a second platform onto which the workpiece or target is mountable. The axis 34 is preferably perpendicular to the workpiece or target. It can further be appreciated, by those skilled in the art, that the second platform can be carried by the base, or that the second platform can be movable relative to the axis 34 as would be the case were the second platform to comprise a conveyor belt, for example. Also, as is well known in the art, a vertical dimension between the second platform and the base can be variable.

For example, variation of the vertical dimension to effect movement of the second platform relative to the assembly 14 can be as outlined below. The base can include means for moving the second platform relative to the assembly 14. Such means can include, for example, a transverse, rotatable shaft supported by bearings, which, in turn, are supported by the legs of the base. The means can further include pinion gears mounted on the shaft. The means can yet further include racks, respectively supported by sleeves. The sleeves can, in turn, be carried by the base. The racks can be affixed to the second platform and can depend downwardly therefrom such that the teeth of each rack are meshable with the teeth of a respective pinion gear. The shaft can further include a wheel at one end thereof for causing the teeth of the gears variably to engage the teeth of the racks, in a known manner, for raising or lowering the second platform relative to the assembly 14 (FIG. 1).

Each gun 16 is preferably independently carried by an arm 60 which, in turn, is carried by and depends from the assembly 14. A first or upper end of Each arm 60 is preferably pivotally connected to the cup 48, and a second or lower end of each arm 60 is preferably pivotally connected to a gun 16, via pins, bolts, or other joining means 62. The joining means 62 are preferably adjustable for varying clamping or joining pressure.

The arms 60 are preferably equally spaced about the circumference of the cup 48 (FIG. 2). Each gun 16 is radially movable from the axis 34 and is vertically adjustable above the turntable or platform by a vertical dimension H (FIG. 1). As to each gun 16, variation can be made in dimension H without moving the turntable or platform relative to the remainder of the assembly 14.

Each gun 16 preferably includes a through bore 64 and a transverse or side inlet port or channel 66 which communicates with the bore 64. Each gun 16 also preferably includes a first conduit 68 which is affixed at a first or inlet end thereof, in a known manner, to one of the plurality of manifold outlets 30, and which is affixed at a second or opposite end thereof, in ike like manner, to the gun bore 64 thereof thereby providing communication between such gun 16 and the manifold 20. Each gun 16 yet further preferably includes a second conduit 70 which is affixed at a first or inlet end thereof, in a known manner, to one of the plurality of cup outlets 49, and which is affixed at a second or opposite end thereof, in like manner, to the gun port 66 thereof thereby providing communication between each such gun 16 and the cup 48. Referring to FIG. 2, it will be noted that the gun 16 and the gun bore 64 are both preferably circular in cross section and, still more preferably, are concentric.

It will be appreciated by those skilled in the art that since the first and second conduits 68, 70 move in unison with the nozzles 16 and cup 48 relative to the workpiece or platform 56 that flexing (and therefore wear caused by such flexing) of the conduits 68, 70 is accordingly minimized.

Preferred operation of the abrasives distributor 10 is as follows. Transport fluid, preferably pressurized air, is introduced into the shaft 18 via the conduit 28. Such fluid passes through the shaft 18, the manifold 20 and the guns 16 (via the gun bores 64). Such fluid transport creates a slight vacuum or drawing effect at the junction of the gun port 66 and the gun bore 64 of each gun 16.

As to the shaft 18, the cup 48, the manifold 20, and each gun 16, rate of angular rotation (or angular velocity) about the axis 34 is variably controllable via the drive means 32. Abrasives are introduced, as above described, into the cup 48, and, depending upon the physical characteristics of such abrasives, the angular velocity of the cup 48 is controlled so as to cause such abrasives to be directed (by centrifugal force or centripetal acceleration) out of the cup outlets 49 into the conduits 70. Gravity then causes such abrasives to be introduced, via the conduits 70, into individual guns 16. Also, the angular velocity of the shaft 18 about the axis 34 can be controlled to obtain a predetermined finish on the workpiece. It can be appreciated, by those skilled in the art, since the above-described abrasives distributor 10 employs a drawing or suction principle to introduce abrasives into the gun 16, that the wear on the guns 16 caused by such abrasives will generally be relatively less than where a forcing or pushing type of action is employed to urge the abrasives through the guns 16.

From the above, it can also be appreciated that orientation of the guns 16 relative to the workpiece is variably controllable. For example, the guns 16 individually can be disposed in a manner such that the abrasives impinge upon or strike the workpiece in a perpendicular fashion by an impact or impingement angle A (FIG. 1), or the guns 16 individually can be re-oriented so that the abrasives strike the workpiece in a non-perpendicular fashion. The impact or impingement angle A as to any one gun 16 is herein defined or described as that angle, 90 degrees or less, between a first line which is on the impinged surface of the workpiece and a second line which is tangent to the path of trajectory of the abrasives exiting such gun 16 at the point where such abrasives impinge upon the workpiece. It can also be appreciated by those skilled in the art that individual guns 16 can have a predetermined gun bore outlet 72 (FIG. 2) such that the abrasives exiting such gun 16 describe a predetermined abrasives spray angle B (FIG. 1).

What has been illustrated and described herein is a novel abrasives distributor. While the abrasives distributor of the present invention has been illustrated and described with reference to a preferred embodiment, the invention is not limited thereto. On the contrary, alternatives, changes or modifications may become apparent to those skilled in the art upon reading the foregoing description. Accordingly, such alternatives, changes or modifications are to be considered as forming a part of the invention insofar as they fall within the spirit and scope of the appended claims.

We claim:

1. An apparatus for impingeably distributing abrasives onto the surface of a workpiece comprising: a rotatable assembly; rotation means for rotating said assembly about an axis relative to said workpiece; a plurality of nozzle means carried by said assembly for impingeably distributing said abrasives onto said surface of said workpiece; said rotatable assembly including first transport means for receiving a pressurized transport fluid and for transporting said fluid to said nozzle means, second transport means for receiving said abrasives and transporting said abrasives to said nozzle means, and a receptacle rotating with said rotatable assembly and into which said abrasives are introduceable; said receptable including a bottom portion supporting the supply of abrasives in said receptacle and a peripheral side wall extending therefrom and centered along said axis of rotation of the assembly and a plurality of radially outwardly directed tubular outlets in said side wall adjacently above the bottom portion thereof for conveying said abrasives under centrifuging influence of the rotating receptacle from support on the bottom portion into and along said outlets to said second transport means; ans said second transport means comprising a plurality of tubular conduits in intermediate communication between said outlets and said nozzle means, each said tubular conduit having an initial, radially directed portion coupled with said tubular outlet and a smooth, gradual downward bend intermediate said initial portion and the associated one of said nozzle mans for gravity assist, whereby centrifugal force causes said abrasives introduced into said receptacle to be expelled therefrom along said radial outlets and into said second transport means, to be carried substantially unobstructed thereby to an associated nozzle means.

2. An apparatus according to claim 1 wherein each respective one of said nozzle means includes a through bore, a first nozzle inlet communicating directly in line with said bore and a second, transverse nozzle inlet which enters said nozzle at a generally downward angle complementary with said downward bend of the associated tubular conduit, said second inlet transversely communicating with said bore; said first transport means distributing said fluid to and through each of said plurality of nozzle means through the respective first nozzle inlet thereof; and said tubular conduits introducing said abrasives into each nozzle through said second inlet thereof; said abrasives thereby being drawn into and through the bore by said transport fluid.

3. The apparatus of claim 1 wherein said first transport means further comprises a manifold comprising a portion of said rotatable assembly and including a plurality of manifold outlets, and a plurality of conduits each joining one of said manifold outlets with a respective one of said first nozzle inlets.

4. The apparatus of claim 1 wherein said assembly further includes means for varying distance between said nozzle means and said workpiece.

5. The apparatus of claim 1 wherein said assembly further includes means for varying angle of impingement upon said workpiece of said abrasives being directed by said nozzle means toward said workpiece.

6. The apparatus of claim 4 wherein said means for varying the distance comprises a plurality of elongated arms, each respective one of said plurality of elongated arms being pivotally connected at one end thereof via first means for imposing variable clamping pressure to said receptacle and being pivotally connected at an opposite end thereof via second means for imposing variable clamping pressure to one of said plurality of nozzle means.

* * * * *